350-3.63 SR
XR 3,972,716
X 350/162 SF

United States
Pressman

[1] 3,972,716
[5] Aug. 3, 1976

[54] COLOR ELECTROPHOTOGRAPHY USING ENCODED MULTICOLOR INFORMATION

[75] Inventor: Gerald L. Pressman, Cupertino, Calif.

[73] Assignee: Electroprint, Inc., Cupertino, Calif.

[22] Filed: Jan. 24, 1972

[21] Appl. No.: 219,935

[52] U.S. Cl. ..... 96/1.2; 96/1 TE; 96/27 H; 350/3.5
[51] Int. Cl.[2] ..... G03G 13/22
[58] Field of Search..... 96/1 R, 27 H, 1.2, 1 TE; 350/3.5

[56] References Cited

UNITED STATES PATENTS

| | | | |
|---|---|---|---|
| 2,962,374 | 11/1960 | Dessauer | 96/1 R |
| 3,057,275 | 10/1962 | Walkup et al. | 96/1 R |
| 3,185,051 | 5/1965 | Goffe | 96/1 TE |
| 3,504,506 | 4/1970 | Macovski | 355/71 X |

OTHER PUBLICATIONS

Yates, "Wave Front Image Formation", British Jour. of Phot., Apr. 22, 1968, pp. 328–331, 343.
Urbach et al., "Properties and Limitations of Hologram Recording Materials", Applied Optics, vol. 8, No. 11, Nov. 1969, pp. 2269–2281.
Schaffert, "Electrophotography", Focal Press, Sept. 1965, pp. 87–96.

*Primary Examiner*—Roland E. Martin, Jr.
*Attorney, Agent, or Firm*—Townsend and Townsend

[57] ABSTRACT

A system for electrostatic photography using a camera having an aperture formed in one side for imaging light onto a photoconductive insulating layer positioned and supported in the camera housing to permit formation of an electrostatic latent image on dielectric film. A contact charging plate including a conductive layer and the photoconductive insulating layer is positioned in the camera so that light passing through the aperture is imaged onto the photoconductive layer. A dielectric camera "film" is positioned adjacent the photoconductive insulating layer and the film and photoconductive layer are pressure biased against each other. A voltage pulse is applied between conductive layers on either side of the dielectric film and photoconductive layer during exposure of the photoconductive layer to an image to establish on the film an electrostatic latent image which is developed with toner marking particles. In one embodiment a color encoding spatial filter is interposed in the path of light imaged on the photoconductive layer for color encoded electrostatic photography. In a preferred form, transparent film is used for developing image transparencies and subsequent printing in black and white and in color is accomplished by electrostatic printing.

10 Claims, 38 Drawing Figures

3972716
OR IN 96/1.2

FIG_1
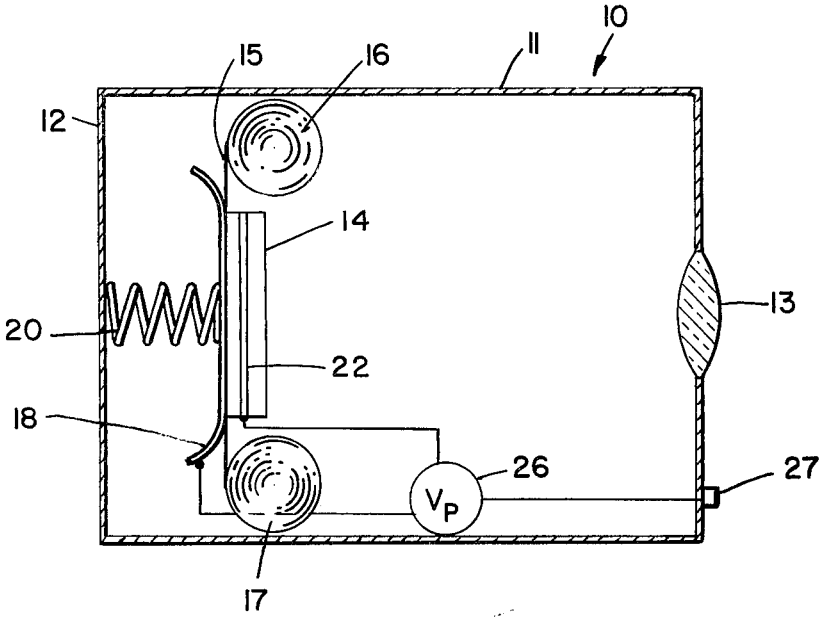
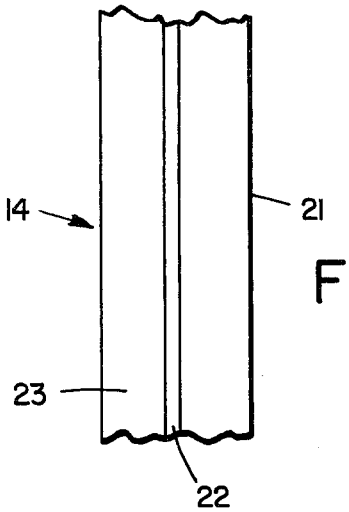
FIG_2
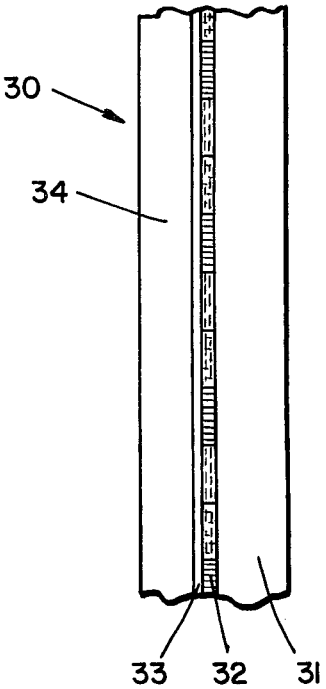
FIG_3
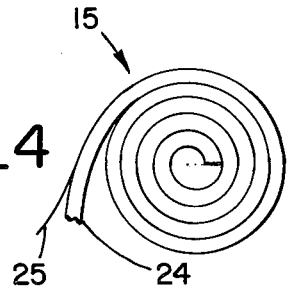
FIG_4
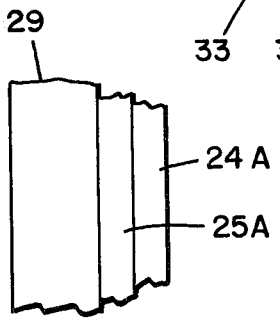
FIG_4A ZERO ORDER IMAGE OF POINT SOURCE (NOT NORMALLY USEFUL)
FIRST ORDER DIFFRACTED IMAGE (USEFUL)
LOWEST ORDER "CROSS-PRODUCT" DIFFRACTED IMAGE (NOT USEFUL)
SECOND ORDER DIFFRACTED IMAGE (USEFUL)

COLOR ELECTROPHOTOGRAPHY USING ENCODED MULTICOLOR INFORMATION

This invention relates to a new system of photography and in particular to a system for electrostatic photography.

It is an object of the present invention to provide a photographic system using electrostatic techniques which do not require the use of specially photosensitized materials containing silver and which permit development of black and white or color transparencies and prints using inexpensive materials and equipment without chemical processing.

The invention generally contemplates various electrostatic cameras having an aperture for imaging light onto a photoconductive insulating plane positioned within the camera housing. In one arrangement, a contact charging plate containing the photoconductive insulating plane is formed by a transparent support plate of glass or plastic facing the aperture, a transparent conductive layer, and a photoconductive insulating layer formed over the transparent layer on the side away from the aperture. The contact charging plate is thus constructed and arranged in the vicinity of the imaging plane of the camera aperture so that light passing through the aperture is imaged onto the photoconductive layer. The invention also contemplates providing in the camera housing means for positioning a "film" of dielectric material adjacent the photoconductive insulating layer of the contact charging plate, and a conductive pressure plate at the back of the camera for pressure application against the film and the photoconductive layer of the contact charging plate. The pressure biasing can be provided, for example, by springs mounted between a removable back on the camera and the conductive pressure plate. During exposure of the photoconductive layer a voltage source provides a pulse of voltage between the transparent conductive layer of the contact charging plate and the conductive pressure plate in order to establish on the film an electrostatic latent image.

In another arrangement, the transparent dielectric film strip is positioned on the side facing the camera aperture and light is imaged through the film onto the photoconductive layer of a contact charging plate. The contact charging plate is arranged so that photoconductive insulating layer faces the aperture adjacent the dielectric film. The film itself can be provided with a transparent conductive backing facing the aperture so that a voltage can be applied across the dielectric film and photoconductive layer during exposure of the photoconductive insulating layer to an image.

The electrostatic dielectric film may be provided in the form of a roll of an elongate strip of dielectric material and an adjacent strip of protective material separable from the transparent dielectric strip. The camera is in that case provided with mechanisms for rolling the film from one position to another adjacent the photoconductive layer. It has been found advantageous to include a conductive backing on the film, transparent where an image is projected through the film and removable during processing if desired.

A feature and advantage of the electrostatic photography arrangement contemplated by this invention is that the exposed "film" upon which electrostatic latent images have been established can be removed and processed for toner development in full daylight. Thus, the film is "processed" by toning the electrostatic latent images with a high resolution electrostatic toner, for example, an electrolytic toner. The apparatus for electrostatically developing the film can be incorporated in the camera.

In a preferred embodiment, the film constitutes a transparent dielectric material so that the final image is a transparency which may be used either as a slide or as a master for producing prints.

The invention further contemplates interposing a color-encoding spatial filter of the type described in U.S. Pat. No. 3,504,606 in the contact charging plate adjacent the transparent conductive layer on the side opposite the photoconductive layer, (i.e., facing the camera aperture). The spatial filter is comprised of a plurality of at least three gratings, each grating including spaced lines of the same color, three of the gratings being of different primary subtractive colors. The focused light falling on the photoconductive layer thereby passes through the spatial filter encoding the object color information in the formed image in the form of a plurality of sets of fine lines corresponding to the respective gratings of the spatial filter. Application of a momentary voltage across the transparent conductive layer and the conductive pressure plate on either side of the film and photoconductive layer during exposure of the photoconductive layer establishes on the transparent dielectric film an electrostatic image which is dusted to provide a black and white image transparency providing all of the original object color information encoded in the form of fine lines which do not appear in the picture unless considerable magnification is used.

A feature and advantage of the electrostatic color photography system contemplated by the present invention is that the color information of the object field is encoded in a black and white transparency which can be used for either direct color projection or for producing color prints.

In order to provide color projection, the black and white transparency having color information encoded in the form of fine lines or gratings is excited or illuminated with coherent light and the diffraction pattern resulting from the plurality of gratings encoded in the black and white transparencies is imaged onto a selective color mask having apertures with color filters of different primary colors according to positions of the diffraction patterns. Because a different diffraction grating is superimposed on each of the different primary colors as they pass through the original spatial filter, each of the different sets of fine lines encoded in the black and white transparency corresponds to a different primary color, i.e., it encodes different primary color information. Upon illumination with coherent light, each set of fine lines produces a different pattern at the diffraction image plane where the color mask is located constituting a spatial frequency spectrum to which colors can be correlated by the mask. Thus, the mask has apertures with red filters in the position of diffraction pattern spots produced by the fine set of lines in the black and white transparency superimposed on red light passing through the original spatial filter and so on for each of the other primary colors as more fully set forth in U.S. Pat. No. 3,504,606.

In color printing, the separation of color information into image components resulting from exciting the black and white transparency with coherent light can be used in sequential electrostatic printing of the color image components. Thus, coherent light illuminates the transparency and is focused onto a mask. The mask is positioned in the Fourier transform plane of the light passing through the transparency and is positioned to have at least one transparent aperture or opening in the location of the diffraction pattern formed by a first one of the sets of fine lines encoded in the image transparency corresponding to a first one of the gratings of the color encoding spatial filter. The light passing through the mask is imaged at an electrostatic printing station to provide a first color image component which is developed at a print receiving medium with toner marking particles of the first color. The mask is then changed to provide at least one transparent aperture or opening at a second position of the diffraction pattern formed by a second one of the sets of fines lines encoded in the image transparency in turn corresponding to a second one of the gratings of the color encoding spatial filter. The second color image component is electrostatically printed over the first with toner marking particles of the second color. The third image component is processed in a similar manner to provide the full color picture.

In a preferred method of color electrostatic photographic printing the electrostatic printing station comprises a multilayered apertured screen comprising at least a photoconductive insulating layer and a conductive layer positioned at a printing station having a source of charged particles on one side and a print receiving medium and back electrode disposed on the other. A double layer charge electrostatic latent image of each image component is sequentially developed across the screen for sequentially modulating the flow of charged particles of different colors corresponding to the image components through the screen in accordance with the sequential electrostatic latent images. Such an electrostatic printing station is set forth by way of example in U.S. patent application Ser. No. 800,236, now U.S. Pat. No. 3,697,164, entitled METHOD AND APPARATUS FOR APERTURE CONTROLLED ELECTROSTATIC IMAGE COLOR REPRODUCTION OR CONSTITUTION with modifications in accordance with the present invention as hereinafter described.

A feature and advantage of the color encoded black and white transparencies incorporated in the present invention is that color projections and color prints from the black and white transparencies are always positive whether the original black and white transparencies are negative or positive. Because the color encoding breaks the black and white image into alternating dark and clear lines or stripes, a shift from negative to positive merely shifts the phase of the alternation of lines with no effect on the final color reconstruction as hereinafter more fully appears.

By means of the electrostatic photographic printing techniques contemplated by the present invention, photographic prints, black and white and color, can be produced which are rugged and can be folded without damage to the image and more easily handled than conventional photographic prints.

Other objects, features and advantages of the present invention will become apparent in the following specification and accompanying drawings.

FIG. 1 is a diagrammatic cross-sectional view of an electrostatic camera embodying the present invention.

FIG. 2 is a detailed diagrammatic side cross-section of the contact charging plate.

FIG. 3 is a diagrammatic side cross-section in detail of another contact charging plate including a color encoding grating.

FIG. 4 is a side view of a roll of electrostatic dielectric film for the camera.

FIG. 4A is a fragmentary detailed side view of an alternate film configuration.

FIG. 10 is a diagrammatic plan view of the diffraction pattern produced by the spatial filter shown in FIG. 7, while

Figure 15:
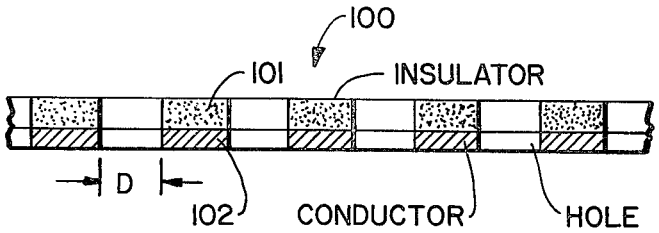
Figure 15A:
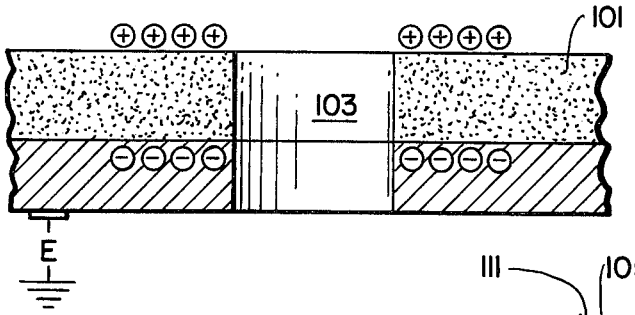

FIGS. 15 and 15*a* are fragmentary side cross-sections of a portion of an electrostatic printing screen for use in producing electrostatic photographic prints.

Figure 16:
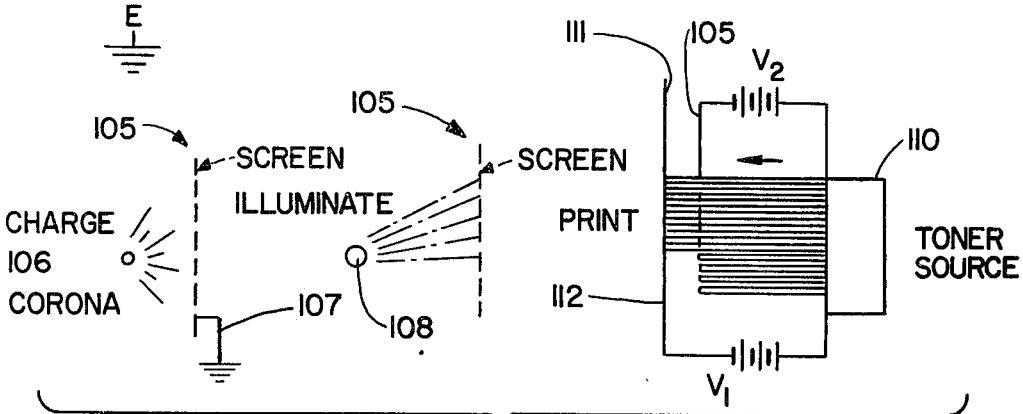
Figure 17:
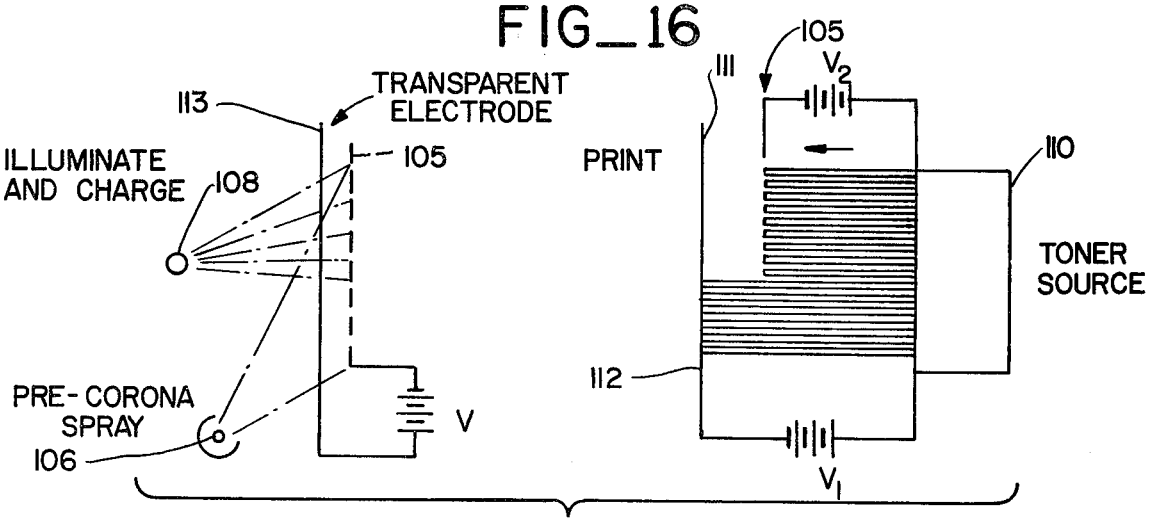

FIG. 16 is a diagrammatic view of the electrostatic printing method while FIG. 17 is another diagrammatic view of the electrostatic printing method using both blocking and enhancing fields.

Figures 18, 18D, 19:
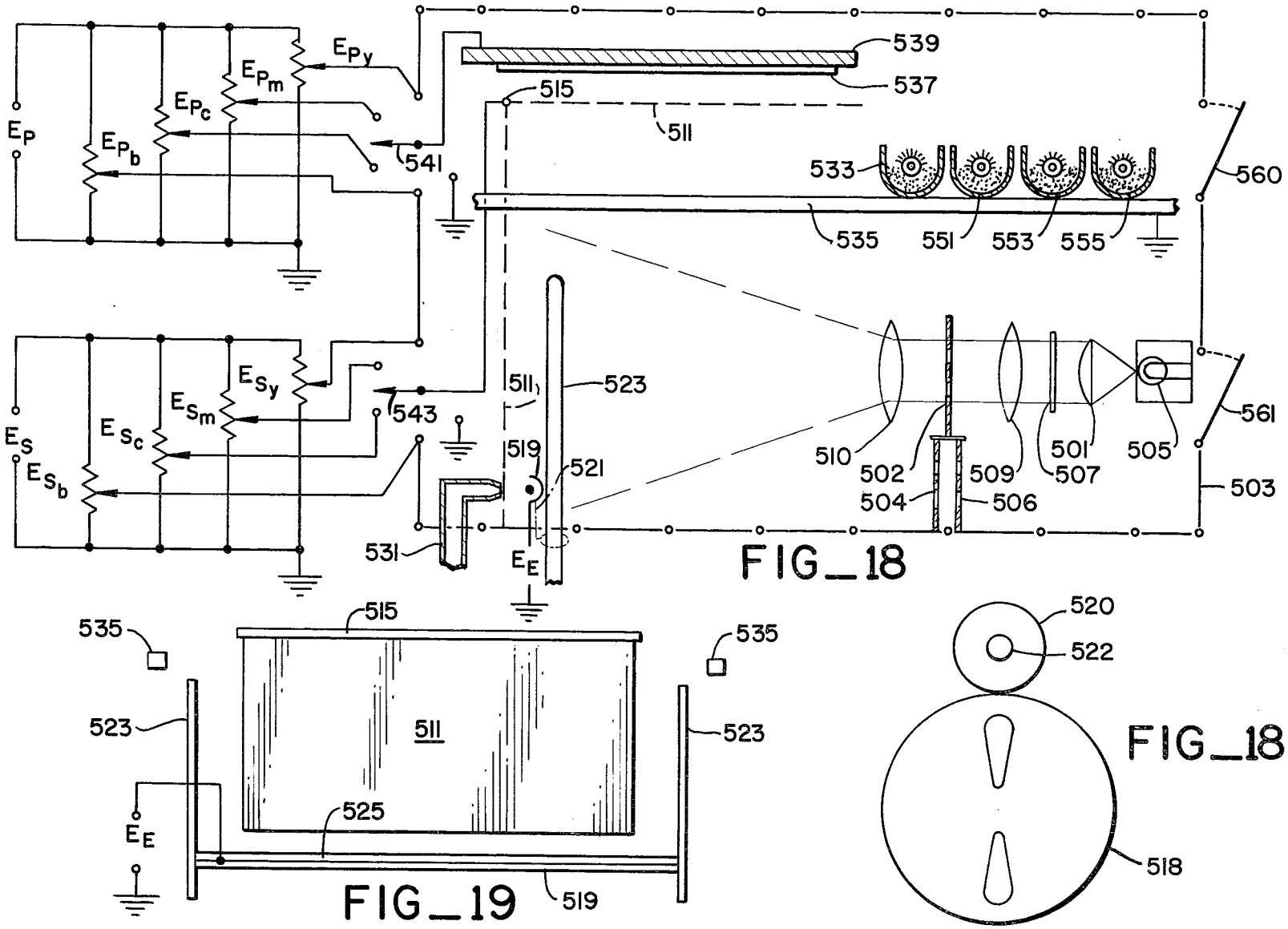

FIG. 18 is a diagrammatic side view of an electrostatic color printer for producing color photographic prints.

FIGS. 18*a*, 18*b*, 18*c* and 18*d* are plan views of binary masks to be used with the color printer.

FIG. 19 is a diagrammatic front view of the screen portion of the printer illustrated in FIG. 18.

Figure 20:
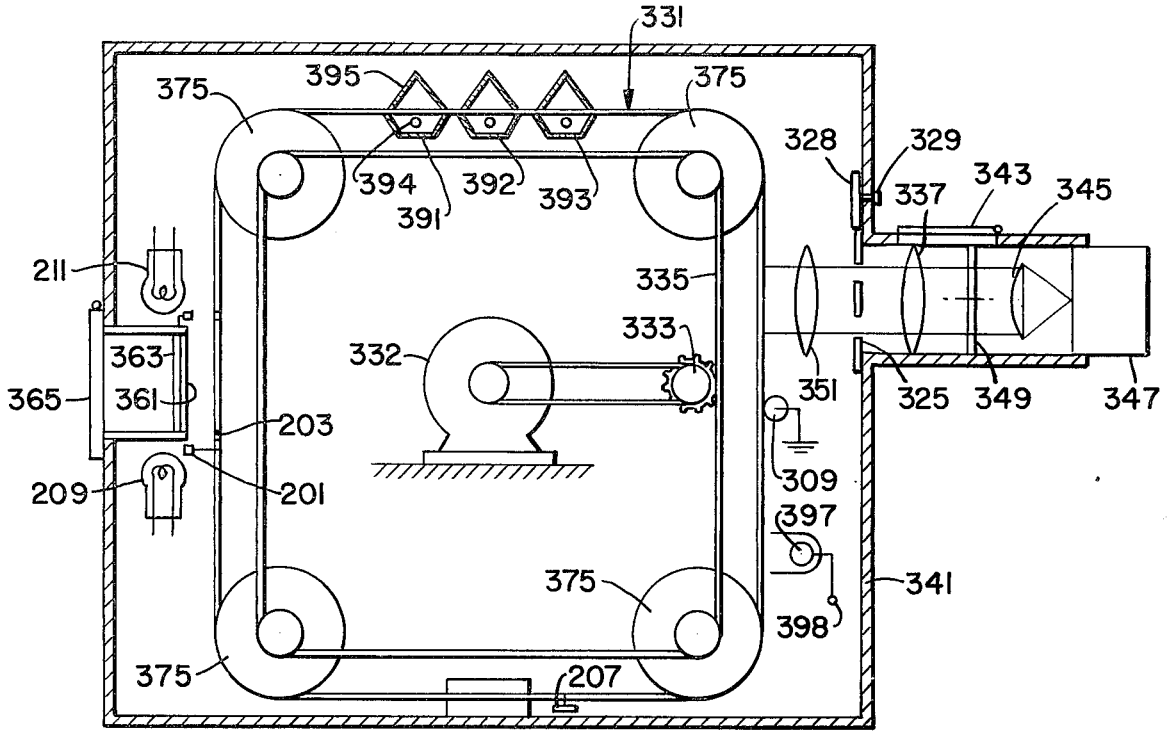

FIG. 20 is a diagrammatic side view of another example of an electrostatic color printer for producing the color photographic prints.

FIGS. 21 – 24 are end cross-sectional views of an electrostatic screen modulator for positive printing.

Figure 25:
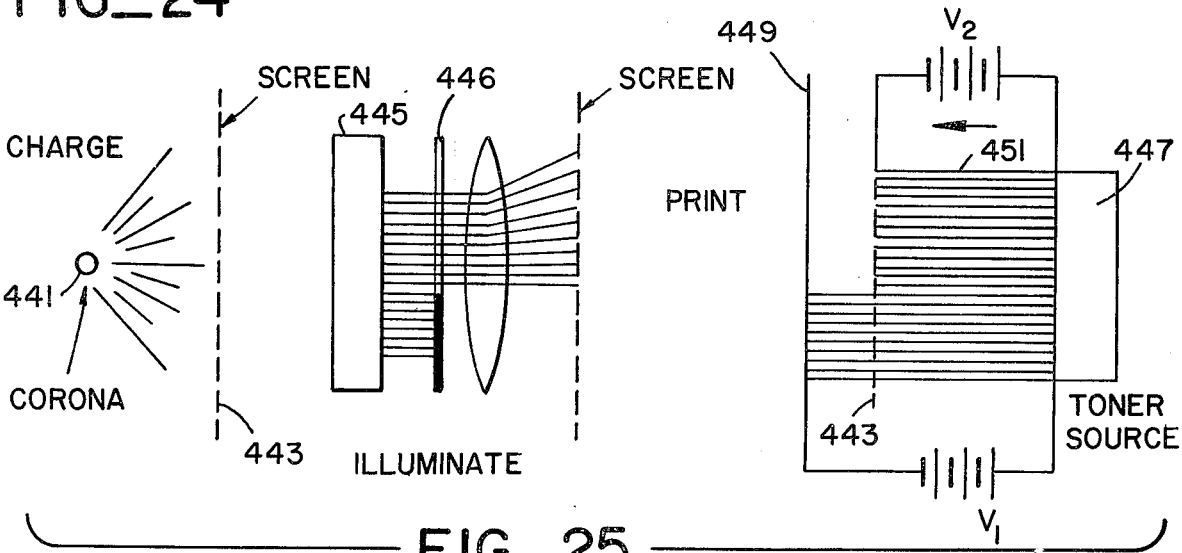

FIG. 25 is a diagrammatic view of a black and white electrostatic printing system.

Figure 26:
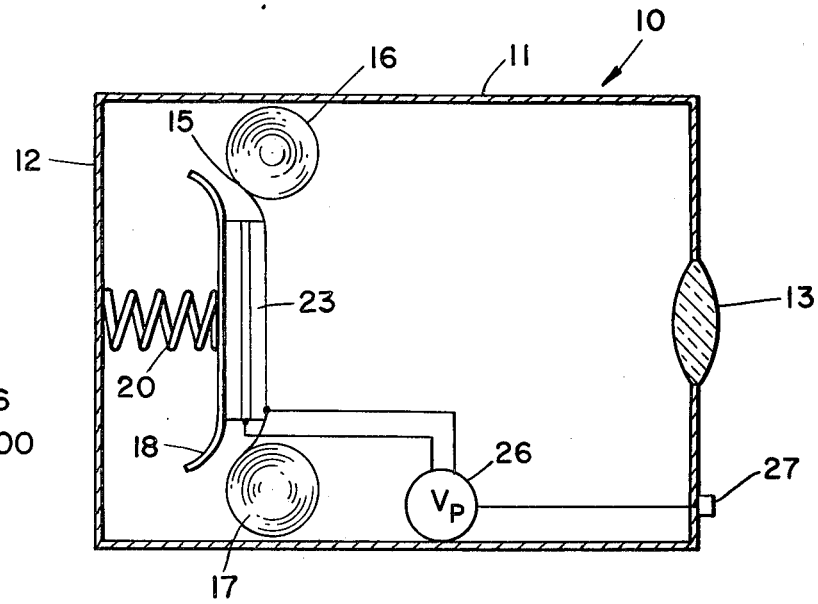

FIG. 26 is a diagrammatic view of another electrostatic camera embodying the present invention.

Figure 27:
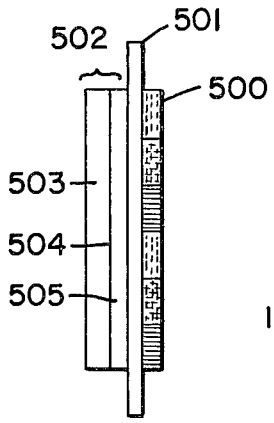
Figure 28:
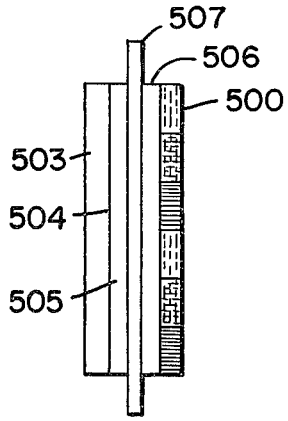
Figure 21:
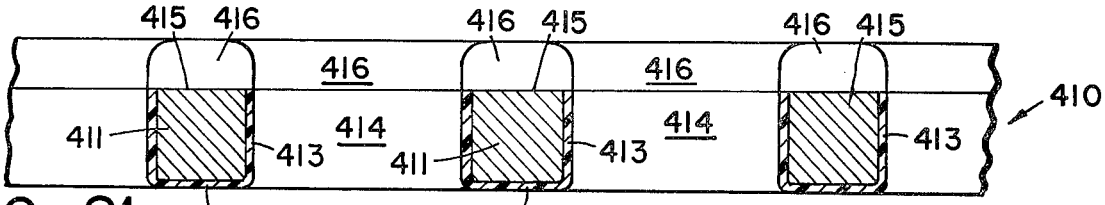

FIGS. 27 and 28 are detailed side views of contact charging plate, film, and color encoding spatial filter arrangements for color photography using the camera of FIG. 26.

In the embodiment of the present invention illustrated in FIG. 1, an electrostatic camera 10 is formed with a housing 11 having a removable back 12 for removing and replacing film, and an aperture at the front containing a lens 13 for imaging light passing through the lens onto a contact charging plate 14 mounted near the rear of the camera. A roll of film 15 is mounted between spindles 16 and 17 for advancement of the film along the back surface of the contact charging plate 14. A conductive pressure plate 18 biased by spring 20 is mounted in the removable back portion 12 of the camera housing so that when the camera is assembled, the pressure plate is biased against the film 15 and contact charging plate 14.

As shown in more detail with reference to FIG. 2, the contact charging plate 14 consists of a transparent support plate 21 of glass or plastic providing structural support. The flat glass or plastic plate 21 is provided with anti-reflective coatings on the side facing the lens aperture. On the side away from the lens, the plate 21 is coated with a layer 22 of transparent conductive material. Coated, in turn, over the transparent conductive layer 22 is a layer 23 of photoconductive insulating material. The contact charging plate illustrated in FIG. 2 is used for black and white photography only as hereinafter more fully described.

As shown in FIG. 4, the film 15 consists of a roll 24 of thin, insulative clear plastic such as Mylar and may include an adjacent, separable, protective layer 25 of paper or other similar material. Alternatively and preferably, a layer of transparent conductive material can be aligned adjacent the dielectric film layer 24 as the adjacent layer 25. This conductive layer, if not transparent, can be stripped off during processing as hereinafter more fully described. The roll of film is formed around a spindle providing an easy-load cartridge. The film is loaded into the camera in the same way that a film roll or film cartridge is loaded into conventional photographic cameras. Thus, the back 12 of the camera is removed and film loaded between spindles 16 and 17, and the back thereafter replaced with the pressure plate 18 against the back surface or photoconductive insulating layer 23 of the contact charging plate 14. Another film configuration is shown in FIG. 4A in which the thin dielectric layer 24A and adjacent conductive layer 25A (either transparent or removable) are supported by a third layer 29 of strong, transparent plastic to provide film strength if layers 24A and 25A are required to be extremely thin.

In operating the camera, an exposure is made by exposing the photoconductive insulating layer 23 of the contact charging plate to an image projected through the transparent support plate 21 and the transparent conductive layer 22. During the light exposure, a momentary pulse of voltage having a duration of, for example, as short as one-thousandth of a second, is applied between the conductive layer 22 on the contact charging plate and the conductive pressure plate 18 which is pressing against the film. The voltage pulse is derived from voltage source 26 under control of a suitable exposure switch 27. Application of the momentary voltage pulse during exposure of the photoconductive layer to a focused image produces a charge image or latent electrostatic image on the surface of the dielectric film 15 which carries the tonal information of the object field or photographed scene. The roll is then advanced for the next picture.

The lens 13 may or may not be provided with a mechanical shutter. In the embodiment illustrated in FIG. 1, no mechanical shutter is provided because exposure of the photoconductive insulating layer to light will not alone establish an electrostatic latent image on the film, i.e., expose the film. It is only a voltage pulse in combination with the exposure of the photoconductive layer which applies a charge image to the film thereby "exposing" the film so that exposure of the film is controlled by a switch 27 which, in turn, controls the voltage source 26.

In FIG. 26 the electrostatic camera is arranged with the transparent dielectric film strip positioned on the side facing the camera aperture and light is imaged through the film onto the photoconductive layer of a contact charging plate. The contact charging plate is arranged so that photoconductive insulating layer faces the aperture adjacent the dielectric film. The film itself can be provided with a transparent conductive backing facing the aperture so that a voltage can be applied across the dielectric film and photoconductive layer during exposure of the photoconductive insulating layer to an image. Corresponding elements are numbered the same as in FIG. 1.

When the exposure of the film roll is completed, the film is processed by electrostatic development with a high resolution electrostatic toner. By way of example, an electrolytic toner can be used as a film slide or a "negative" or master for photographic printing. A feature and advantage of the foregoing arrangement is that the film is at no time light-sensitive and processing can be carried out in full daylight.

Figure 5A:
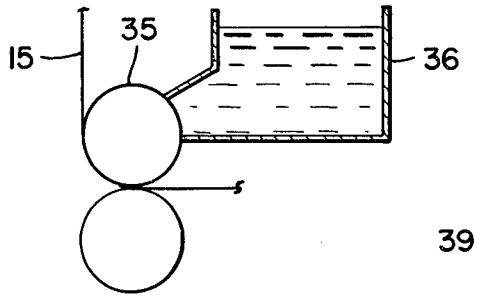
FIGS. 5A and 5B are diagrammatic views of toner developing stations for developing the electrostatic latent image formed on the camera film.
Figure 5B:
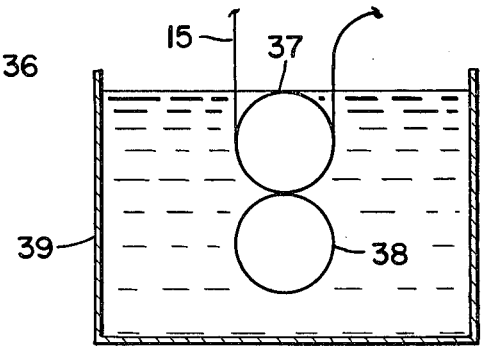

Two alternative simple developing stations for developing the "exposed" dielectric film are illustrated in FIGS. 5A and 5B. As shown in FIG. 5A the exposed dielectric film 15 upon which electrostatic latent images have been established is fed between a pair of rollers. The roller 35 on the exposed side of the film 15 applies conventional liquid toner supplied by toner source 36 to the surface of the film where it adheres in accordance with the established electrostatic latent images. Thus, the liquid toner source 36 coats the surface of roller 35 which in turn transfers the liquid toner to the electrostatic images. The toner can thereafter be air dried or otherwise heat fixed according to the permitted residence time of the toner on the film during drying.

In FIG. 5B another type of conventional liquid toner developer is illustrated in which a pair of rollers 37 and 38 guide the dielectric film through a tank 39 of liquid toner in which the film 15 is completely immersed. The liquid toner however, is retained on the film surface only in accordance with the electrostatic charge configurations.

Figure 6:
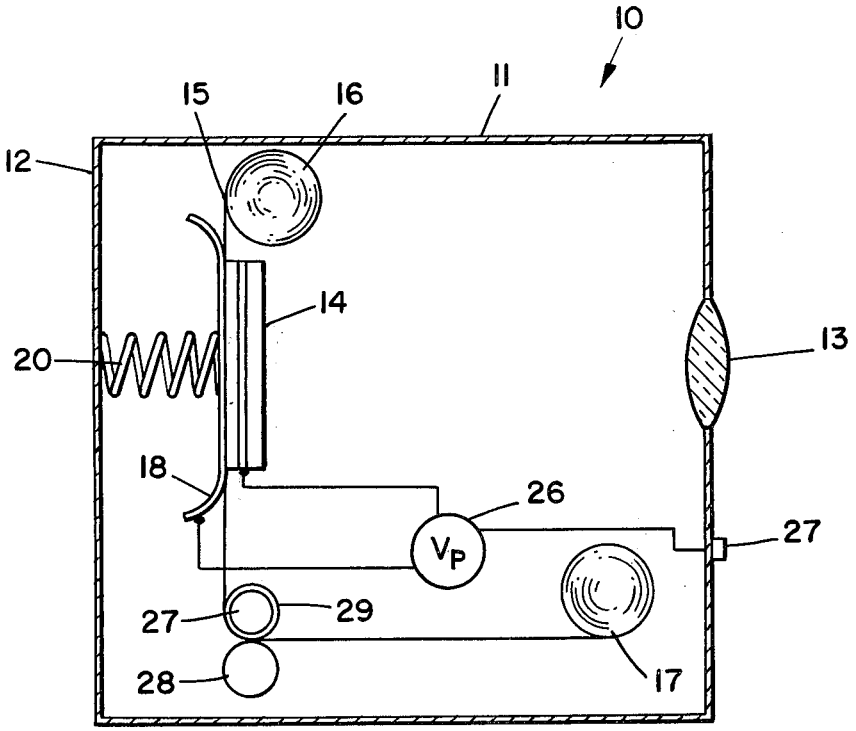
FIG. 6 is a diagrammatic view of an electrostatic camera having the developing apparatus incorporated in the camera.

In FIG. 6 an electrostatic camera similar to that illustrated in FIG. 1 is shown incorporating a toning system for immediate film development within the camera. As shown in FIG. 6 the camera elements are numbered the same as in FIG. 1 except that the dielectric film 15 prior to passing to the take-up reel 17, which has been relocated passes between rollers 27 and 28. Roller 28 functions as a pressure and guide roller while roller 27 is of more complex construction. The roller 27 is a porous roller containing liquid toner material for application to the exposed dielectric film upon which electrostatic latent images have been established. The porous roller 27 is formed with a fibrous or absorbent material layer 29 around its surface for controlled transfer and delivery of the toner within the roller to the surface of the film 15. The liquid toner filled roller 27 contains enough liquid toner for application to the entire roll of film and is incorporated in a disposable film cartridge with each roll of film. Thus each roll of dielectric film is associated with a replacement roller 27 for toner development which is removed with each exposed roll of film from the camera. The take-up reel 17 is spaced from the developer roll 27 to permit sufficient drying residence time.

A contact charging plate for use in color electrophotography is illustrated in FIG. 3. In this embodiment, the elements of the camera remain the same as in FIG. 1, but the contact charging plate is modified by interposing a color-encoding spatial filter between the glass or plastic support plate and the transparent conductive layer. As shown in FIG. 3, the contact charging plate includes a transparent glass or plastic support plate 31 to which is adhered the color-encoding spatial filter 32, hereinafter described. Coated over the filter 32 is the layer 33 of transparent conductive material over which is, in turn, coated the layer 34 of photoconductive insulating material.

Figure 7A:
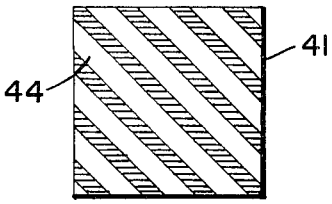
FIG. 7 is a diagrammatic plan view of one form of color encoding spatial filter while FIGS. 7A, 7B and 7C constitute the grating components of the filter.
Figure 7B:
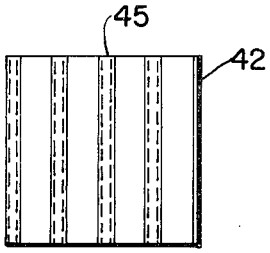
Figure 7C:
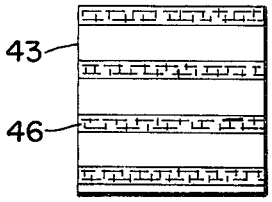
Figure 7:
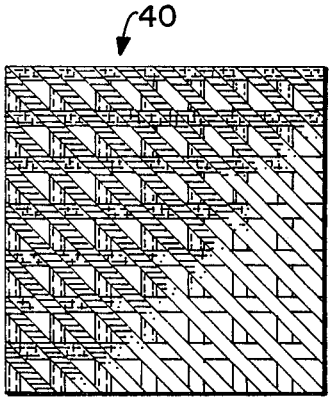
Figure 8:
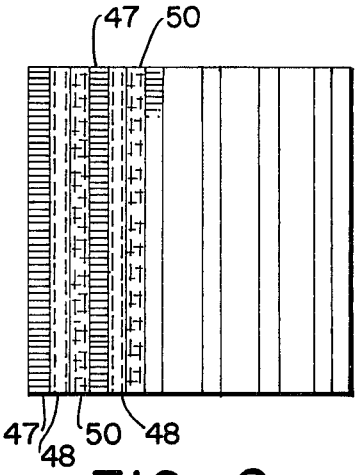
FIGS. 8 and 9 represent diagrammatic plan views of other types of color encoding spatial filters.
Figure 9:
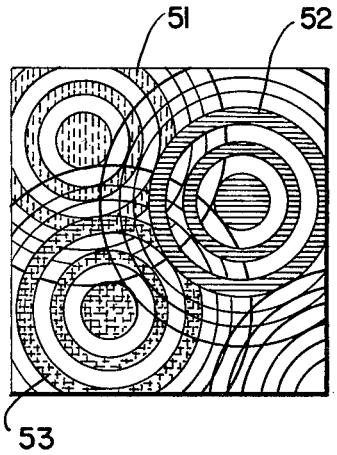
Figure 18A:
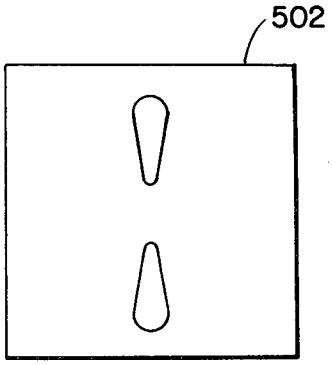
Figure 18B:
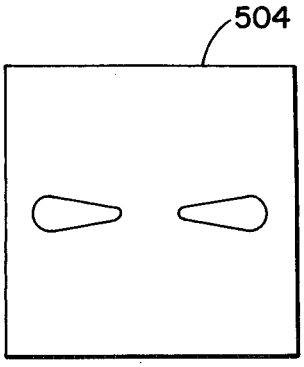
Figure 18C:
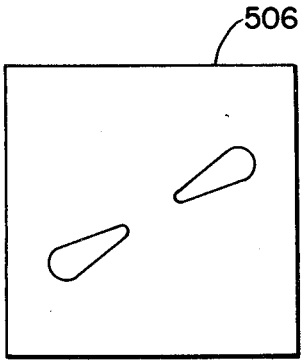

The color-encoding spatial filter is of the type described in U.S. Pat. No. 3,504,606. In the spatial filter 40 illustrated by way of example in FIG. 7, three different grids or line gratings 41, 42 and 43 shown separately in FIGS. *7a*, *7b*, and *7c*, respectively, are superimposed to provide a filter of three superimposed rulings or gratings. Each grating has its own angular orientation and each grid has lines of the same color separated by clear spaces. Each grating is selected to be of a different one of the negative or subtractive primary colors, cyan, magenta, and yellow. Thus, the color lines 44 of grating 41 are cyan, the color lines 45 of grating 42 are magenta, and the color lines 46 or grating 43 are yellow. The various gratings are supported on a transparent sheet so that the spaces between lines of the gratings are clear and the filter provides an effective spatial frequency filter or color encoder. Another arrangement for a spatial frequency encoder is shown in FIG. 8 in which the three gratings comprise three sets of parallel lines 47, 48, and 50, respectively. The three grids of parallel lines are arranged so that each has a different number of lines per inch or a different frequency and the grids are superimposed in parallel adjacent relationship to one another. Yet another example of a color-encoding spatial filter is illustrated in FIG. 9 in which the spatial filter comprises three Fresnel zones 51, 52, and 53, the colored rings of which are respectively cyan, magenta and yellow. The Fresnel lens zones can be positioned relative to one another in any convenient manner; one example being shown in FIG. 9. The concentric color rings of each Fresnel zone are separated by clear spaces.

Referring again to FIG. 4, light imaged through lens 13 passes through the color-encoding spatial filter onto the adjacent photoconductive layer encoding the color information about the object field or scene to be photographed in the image in the form of three sets of fine lines corresponding to the three gratings of the color filter. With the application of a voltage pulse, the same information is similarly encoded in the resulting electrostatic latent image formed on the film, which upon development provides the positive black and white transparency having the color information encoded in the form of three sets of fine lines visible only upon magnification. Referring by way of example to the use of the spatial filter illustrated in FIG. 7, images of red objects appear in the final black and white transparency with a superimposed grid of fine line shadows oriented at the angle of the cyan grating component 41 of the spatial filter. This result is achieved because the cyan color lines are opaque to the red light forming a diffraction grating with respect to red light only while the magenta and yellow grating components are transparent to the red light. Similarly, the other primary color portions, the green and blue portions of the photograph seen, are superimposed with line shadows oriented at the angles of the magenta (minus green) and yellow (minus blue) lines of the grating components 45 and 43, respectively. The spaces between the fine lines encoded in the black and white transparency have grey scale densities appropriate to the brightness of the object photographed. Colors which are additive combinations of the primary colors, red, green and blue become encoded with various additive combinations of the superimposed gratings so that all of the color information is encoded. The Fresnel lens type spatial filter illustrative in FIG. 9 will have three images corresponding to the three Fresnel zones with superimposed fine concentric line rings on them, the cyan zone placing rings on the red images, the magenta zone placing rings on the blue images and the yellow zone placing rings on the green images.

The result of electrophotography using the contact charging plate of FIG. 3 containing the color-encoding spatial filter is thus a black and white transparency having three sets of fine lines corresponding to the three grating components of the spatial filter and containing the image color information. With grating lines in the order of, for example, three hundred lines per inch, the lines are not visible to an observer unless considerable magnification is used. Thus, the lines do not interfere in the appearance of the black and white picture. The spatial filters can be fabricated in a variety of ways as set forth in the U.S. Pat. No. 3,504,606.

Contact charging plate, film, and color encoding spatial filter arrangements for color photography using the camera configurations of FIG. 26 are illustrated in FIGS. 27 and 28. In FIG. 27 the color encoding spatial filter 500 of the type described above is supported against the film 501 on the side opposite the contact charging plate 502 and facing the aperture of the camera. The contact charging plate 502 consists of a support 503, conductive layer 504 and photoconductive insulating layer 505. In FIG. 28 a transparent conductive coating 506 is formed over the color encoding spatial filter 500 so that it is positioned between the film 507 and spatial filter 500 and maintained in contact with the film. In the arrangement of FIG. 27 the film 501 must include a conductive layer facing the aperture to which a voltage can be applied as described with reference to FIG. 26. In the arrangement of FIG. 28, however, the transparent conductive layer 506 can be used to apply a voltage on that side of the film so that the film 505 does not require a conductive layer and can consist of only the dielectric layer. In either case the voltage on the other side of the film is applied to layer 504.

In order to recover the color information, the black and white transparency is excited or illuminated with coherent light which is diffracted according to the fine sets of lines encoded in the transparency. The result is a diffraction pattern in the Fourier transform plane of the diffracted light depending upon the configurations of the sets of fine lines. In the spatial filter, the grating components are advantageously oriented with respect to each other in order to facilitate separation of the respective diffraction patterns formed by the fine line sets encoded in the black and white transparency. For example, in the type of filter illustrated in FIG. 7, one grid can have its lines oriented horizontally, another grid have its lines vertical, while the third grid have its line oriented at an angle of 30° with respect to the horizontal diffraction grating lines. Using such a filter in the system of color electrophotography described above to provide a black and white transparency with the grating lines encoded therein and exciting the resulting transparency with coherent light, results in the diffraction pattern illustrated in FIG. 10. The various diffraction spots can be separately identified as originating from different ones of the three grating components encoded in the transparency so that the light diffracted by each of the gratings can be separated. For example, mask 11 can be positioned at the plane of the diffraction image with apertures oriented to pass useful light diffracted from selected ones of the grating components encoded in the transparency. Thus, in mask 60 apertures 61 and 62 isolate the diffraction images 63, 64, 65 and 66 originating from lines formed by the yellow grating component shown in FIG. 7*c*, apertures 67 and 68 isolate the diffraction images 70, 71, 72 and 73 originating from lines formed by the cyan grating component shown in FIG. 7A, while apertures 74 and 75 isolate diffraction images 76, 77, 78 and 80 originating from lines formed by the magenta grating component shown in FIG. 7B. Since the yellow grating component forms a shadow image on the transparency from blue light, the fine lines in the black and white transparency produced by the yellow grating component encode blue color information, and with apertures 61 and 62 covered with blue filters, the blue component of the original object field or photographed scene is restored to its original color. Similarly, the cyan component of the spatial filter diffracts red light so that the fine lines encoded in the black and white transparency by the cyan grating component encodes the red information. This can be restored by appropriately covering the apertures 67 and 68 with red filters to properly color the red image component of the original object field or photographed field. Finally, apertures 74 and 75 can be covered with green filters to provide the correct color for the green image component encoded by the magenta grating component of the spatial filter.

Figure 10:
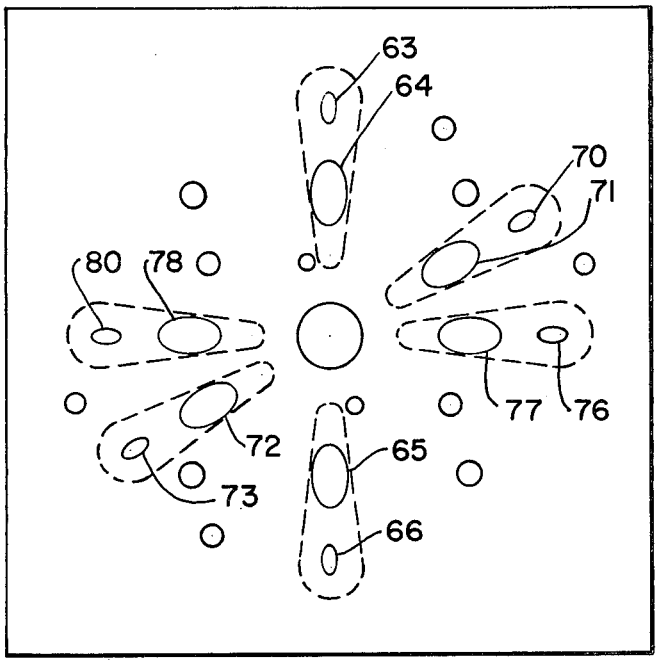
Figure 11:
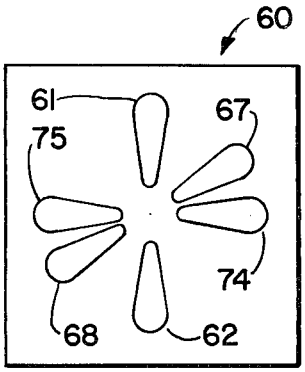
FIG. 11 is a diagrammatic plan view of a color mask for use with the grating of FIG. 7.
Figure 13:
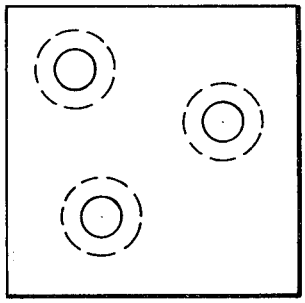
FIGS. 12 and 13 illustrate plan views of color masks for use with the gratings of FIGS. 8 and 9 respectively.
Figure 12:
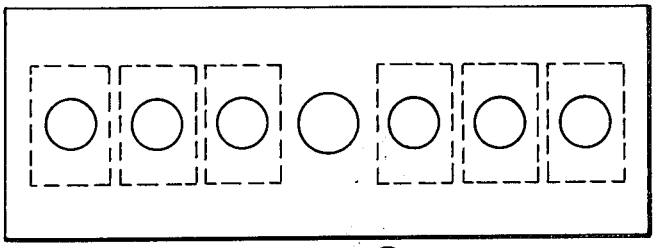
Figure 14:
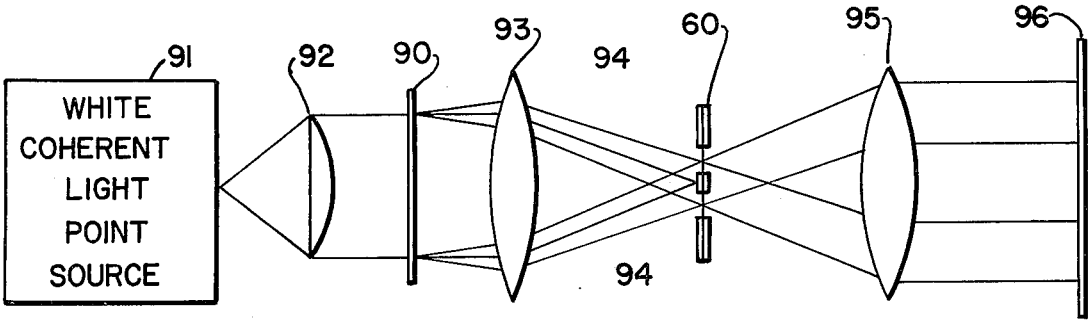
FIG. 14 represents a projector for providing color pictures from the color encoded black and white transparency.

An arrangement for a projection system capable of providing a color image from the information encoded in the black and white positive transparency is shown in FIG. 14. The light projector 91 provides a source of coherent light, for example, through a pin-hole opening, and the light is collimated by lens 92 through the black and white transparency 90 which carries the encoded information. The light is diffracted by the sets of fine lines in the transparency produced by the spatial filter and the diffracted light is focused by lens 93 onto the mask 60 described with reference to FIG. 11. The mask 60 is positioned in the image plane of the diffraction pattern, the Fourier transform plane, of light from source 91 and the mask is suitably positioned so that diffraction image spots originating from different lines of the sets of lines or gratings encoded in the transparency fall on appropriate apertures of the mask 60 which are provided with primary color filters. The color filters in the apertures color the light passing through so that the separated image light components are colored to provide the primary color image components which recombine upon passage of the light through the mask and are focused by lens 95 to form a full color image on screen 96. In the event a Fresnel zone spatial filter of the type illustrated in FIG. 9 is used, then the mask and mask aperture would be of the configuration illustrated in FIG. 13 while if the spatial filters of the type illustrated in FIG. 8 are used the corresponding color mask and filter would be of the type illustrated in FIG. 12 as more fully described in the U.S. Pat. No. 3,504,606. In each of the FIGS. 9 and 10 the solid lines represent a diffraction image spot at the diffraction image plane, while the dotted lines represent the apertures which can be cut in the mask to provide the desired separation of the image light components. In FIGs. 10 and 12 the undiffracted central spot is thus eliminated.

A system for producing electrostatic photographic prints from the black and white transparency according to the present invention is described herein with reference to FIGS. 15 through 19. The invention generally contemplates electrostatic reproduction of black and white and color prints from the transparency using apertured screen electrostatic printing of the type, for example, set forth in U.S. patent application Ser. No. 776,146 entitled APPARATUS FOR APERTURE CONTROLLED ELECTROSTATIC IMAGE REPRODUCTION OR CONSTITUTION, and U.S. patent application Ser. No. 800,236 entitled METHOD AND APPARATUS FOR APERTURE CONTROLLED ELECTROSTATIC IMAGE COLOR REPRODUCTION OR CONSTITUTION. In this type of printing, a multilayered apertured screen 100 of the type illustrated in FIG. 15 comprising at least an insulated layer 101 and conductor layer 102 is used to modulate a cross-sectional density flow of a stream of charged particles in accordance with the image to be printed. In order to accomplish this a double layer charge electrostatic latent image or "bi-polar" electrostatic latent image is formed across the face of the screen corresponding to the image to be reproduced. As shown in FIGS. 15A, charges of opposite polarity are thereby accumulated on either side of the insulator layer 101 so that electrostatic lines of force extend within the apertures 103 of the screen 100 permitting precise control over the passage of charged particles through the apertures of the screen.

One arrangement for printing black and white prints is illustrated diagrammatically in FIG. 16. In this arrangement the insulative layer of the apertured screen constitutes a photoconductive insulating material. As shown at the left of FIG. 16, the photoconductive insulating layer of screen 105 is initially charged by means of a corona wand or source 106 which sprays a uniform charge across the face of the screen. During charging of the insulative layer of the screen which takes place in the dark the conductive layer is maintained at a fixed potential such as, for example, ground by means of lead 107 so that an equal and opposite charge is established on either side of the photoconductive insulating layer. In the next step as shown in FIG. 16, the equal and opposite double layer charges are selectively dissipated by illuminating the screen 105 with a light source 108 patterned in accordance with the black and white transparency image (not shown) to be printed. In the next step, the screen 105 is interposed in a printing station which includes a toner source 110 in which toner particles are charged in a conventional manner and a print receiving medium 111 such as, for example, paper between which the screen 105 is positioned. A propulsion or accelerating field $V_1$ is established between the toner source and a conductive backing plate 112 which supports the paper while the conductive layer is maintained at an intermediate potential $V_2$. The passage of toner particles from the toner source to the print receiving medium is selectively controlled by the fringing fields within the apertures of the screen 105 so that the particles come to rest on the print receiving medium in accordance with the pattern to be reproduced. In this arrangement, a negative print of the black and white transparency used to expose the screen 105 would generally be obtained. Thus, the double layered charge initially established across the screen is oriented to block the passage of particles through the apertures of the screen. Upon illumination of selected portions of the screen, the blocking field is selectively dissipated thereby permitting passage of toner particles through the apertures of the screen illuminated by the image of the black and white transparency.

In the arrangement of FIG. 17, direct positive printing from the positive black and white transparency developed from the camera is provided. According to this method, the screen 105 is illuminated with light from source 108 patterned in accordance with the image to be reproduced at the same time that a field V is applied between the conductive layer of screen 105 and the transparent conductive electrode 113. The illuminated areas of the photoconductive layer of the screen become conductive and under the influence of the applied charging field V between the conductive layer of the screen and transparent electrode 113 acquire a charge separation of the type shown in FIG. 3 in a pattern and in accordance with the image to be reproduced. After the charge separation is formed, the illumination is removed so that the photoconductive layer becomes again an insulator. The applied field V is then removed and portions of the screen which were illuminated retain a charge separation producing fringing fields within the aperture oriented to block the passage of toner particles during the later printing process. This technique thus produces positive reproductions of the positive black and white transparency. In addition, enhancing fringe fields can be established within the apertures intended to pass toner particles. Thus, instead of being merely neutral with respect to charged particles directed through the screen, enhancing fields can be established which focus and concentrate the toner marking particles in the apertures where printing is intended. This is accomplished by positioning the corona source 106 for providing an additional electric field across the face of the screen. Thus, during illumination of the photoconductive layer of the screen with the image derived from the black and white transparency and during application of the field V, the screen is also sprayed by corona source 106 so that the dark or unilluminated portions of the screen acquire a charge opposite that applied by field V to the illuminated portions of the screen. Thus, the dark portions of the photoconductive layer which remain in an insulating condition acquire charges sprayed by corona source 106 to provide within the apertures of the dark portions of the image pattern, fringing fields which accelerate and enhance the flow of the toner particles through those apertures of the screen. The result is positive printing with increased contrast using the printing station and method of FIG. 17 similar to that in FIG. 16.

A preferred arrangement for positive electrostatic printing is illustrated in FIGS. 21–27 and can be incorporated with advantage in the present invention. It is described in further detail in U.S. patent application Ser. No. 85,070 entitled Electrostatic Modulator For Controlling Flow Of Charged Particles.

As shown in FIGS. 21 through 24, an electrostatic screen modulator 410 is constructed with a screen or mesh base 411 of metal or other conductive material. The metal screen base 411 is coated on one surface 412 of the screen and on the inside walls 413 of the screen apertures with a layer 414 of ordinary electrical insulator material, preferably having a high dielectric strength as well as high resistivity. The opposite surface 415 of the metal screen base 411 is coated with a layer 416 of a photoconductive insulating material.

In forming the screen, the metal screen base 411 is first coated with the layer 414 of insulator material along one surface 412 of the screen and on the inside walls 413 defining the apertures or holes through the screen. The insulator material can be applied, for example, by spraying the screen from one side. This may result in some deposition of the insulator material 414 on the opposite surface 415 of the screen. Such material can be removed by rubbing the surface 415 with abrasive material after the screen has been sprayed from one side. The photoconducting insulative material is then applied to the uncoated surface 415 of the screen. The photoconductor material is preferably applied so that coating of the internal walls of the screen holes is avoided, but a small degree of internal coating can be tolerated. Such selective coating of the surface 415 of the screen base 411 can be accomplished by electrostatic spraying of the photoconductive material after first charging the insulator layer 414 with charges similar to that applied to the photoconductive material 416. The photoconductor 416 is thereby repelled from the insulator surfaces 414 during deposition so that separation of the coatings 416 and 414 results. The entire surfaces of the metal screen base 411, however, are coated with an insulative layer, either 414 or 416.

Figure 22:
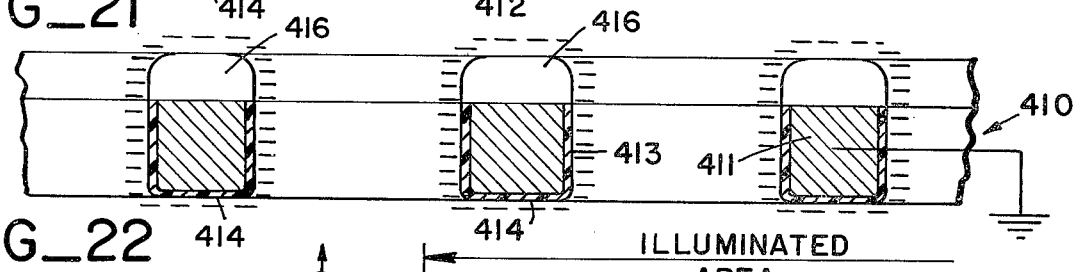
Figure 23:
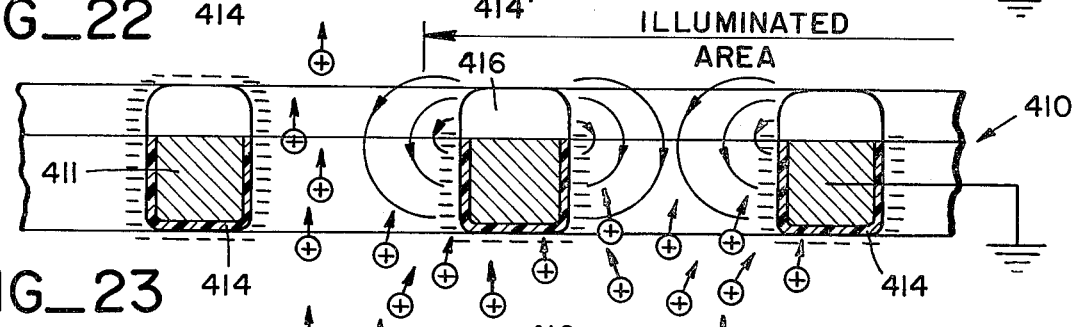

According to one mode of operation of the screen 410 shown in FIGS. 22 and 23, the screen is positioned so that the screen surface coated with insulator layer 414 faces a toner source or other source of charged particles, (such as ions generated by a corona). The modulator screen 410 is first charged uniformly over its entire surfaces so that the potentials on the insulator layer 414 and photoconductive layer 416 on opposite surfaces of the screen are approximately the same. In FIG. 22, a negative charge is shown by way of example and the conductive screen base 411 is maintained at a ground potential or at a selected fixed potential during the charging process. Charging of the surfaces of the modulator screen 410 is accomplished, for example, by corona discharge currents from a corona spray source or corona wand. As a result of the uniform charge distribution across the surfaces of the screen, there are no potential differences across the screen and no fringing fields or lines of force extend axially through the holes in the screen, as shown in the charge configuration of FIG. 22. A bipolar electrostatic latent image corresponding to a pattern to be reproduced is thereafter established by selectively dissipating the charges deposited on the photoconductive layer 416. Selective dissipation of the charge layer on the photoconductive material 416 is accomplished by projecting on the screen 410 and illuminating the photoconductive layer 416 with light in the pattern of the image to be reproduced while the conductive screen base 411 is maintained at a fixed potential or ground potential as shown in FIG. 23. The negative charges initially deposited on the photoconductive material 416 are selectively conducted away in the regions illuminated with light, the photoconductor potential approaching the potential of the conductive screen 411 in the illuminated regions. As a result of the selective charge dissipation, a charge inequality of varying magnitude is established across the surfaces of the screen, thereby producing fringing fields of electrostatic lines of force axially through the screen apertures or holes in the illuminated portions of the screen. As shown in FIG. 23, the fringing fields of force within the apertures act to block or attentuate the passage of positively charged toner particles or ions that may be directed towards the screen. The initial flow of charged particles, such as charged toner particles or corona produced ions, is created by an overall applied electrostatic accelerating field in which the modulator screen is interposed to modulate the established flow of charged toner particles. In the non-illuminated portions of the screen, the absence of force fields within the apertures renders those portions of the screen passive to the charged toner particle flow thereby permitting passage of the toner as also shown in FIG. 23. The strength of the fringing force fields established within the apertures of the screen is proportional to the extent of charge dissipation from the photoconductive layer 416 which is in turn proportional to the extent of light illumination. The apertures of the screen thereby permit a modulated control over the flow of charged particles along a continuous range from passing to completely blocking the flow of charged particles in any particular aperture.

Figure 24:
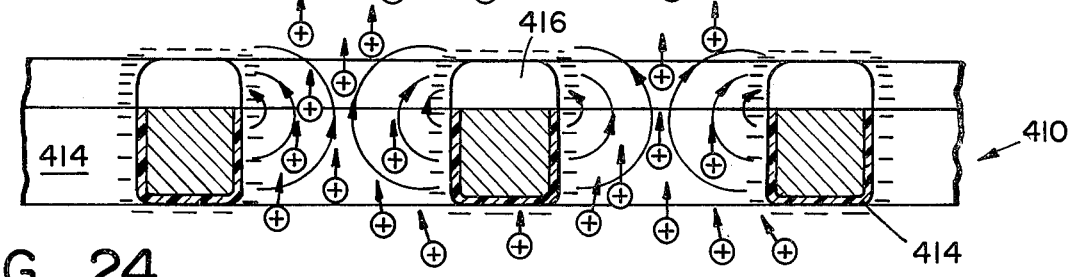

It should be noted that the photoconducting insulative coating is formed thicker than the ordinary insulative coating formed on the other side of the screen. Under these circumstances and as shown in FIG. 24, a greater potential can be acquired on the photoconductive surface of the screen than on the opposite surface, thereby establishing a uniform charge inequality across the face of the screen or at least along the wall or reaches of the apertures. The resulting fringing fields of force established within the screen apertures are oriented to provide "enhancing fields" or accelerating fields in this example with respect to positive toners. The enhancing fields increase the flow of positively charged toner particles or ions through the portions of the screen corresponding to dark areas which have not been illuminated, improving the printing density in these areas. Thus, as shown in FIG. 24, a flow of positively charged particles, such as charged toner particles, established by an overall applied accelerating electrostatic field, are further accelerated and enhanced in the apertures of the screen by the fringing force fields. Illumination of portions of the screen by a light pattern as heretofore described, with the metal screen base 11 maintained at a fixed potential, results in selective dissipation of the charge deposited on the photoconductive layer 16 weakening the enhancing fields in some regions, neutralizing or eliminating the fringing fields of force in other apertures, and reversing the bipolar electrostatic fields in other apertures, to produce blocking fields of variable strength. Thus, a bipolar electrostatic latent image, containing established force fields within the apertures ranging from enhancing to blocking, is established in accordance with an image to be reproduced.

In the embodiments of the present invention illustrated in FIGS. 21 through 24, the metal or other conductive screen base is coated over its entire surfaces with insulative material, either ordinary insulating material or photoconductive insulating material. The insulative coatings can be applied to a variety of conductive screens such as, for example, etched metal or woven wire screens, and in a variety of configurations as further described in Ser. No. 85,070 referred to above.

A positive electrostatic printing system according to the present invention is shown diagrammatically in FIG. 25. An electrostatic screen modulator 443 of the type, for example, illustrated in FIGS. 21 through 24 is initially charged from both sides by means of, for example, corona wand 441 so that a like charge is established over substantially all of the surfaces of screen 443, as heretofore described. The screen 443 can be charged uniformly over all of its surfaces so that there are no fringing fields within the apertures of the screen, or so that a greater potential is acquired by the photoconductive side of the screen to establish a uniform charge inequality across the face of the screen and enhancing fringing fields of force within the screen apertures. The screen 443 is thereafter illuminated by a source 445 which displays on the surface of the screen coated with photoconductive insulating material a light pattern corresponding to image transparency 446 from electrostatic camera 10 to be printed. At the same time, the metallic or other conductive screen core is grounded or maintained at a fixed potential to selectively dissipate the charge deposited on the photoconductive layer in proportion to the intensity of light projected on different portions of the screen. A bipolar electrostatic latent image is thereby established and is supported on the screen and the screen 443 is interposed between a toner source 447 and a back electrode and print-receiving medium 449. The toner source 447 is maintained at a fixed potential for charging the toner particles and an overall accelerating or propulsion field is established between the toner source 447 and back electrode and print-receiving medium 449. The polarities are arranged so that charged toner particles from source 447 are accelerated toward the electrode 449 creating a flow of charged toner particles. The flow of particles is intercepted and modulated by screen 443 interposed in the toner flow path. The unilluminated portions of screen 443 corresponding to the dark portions of a pattern to be reproduced are passive to the flow of toner particles having a charge opposite that on the screen, or enhance the flow of toner particles, permitting deposition of dark toner particles on print receiving medium 449 corresponding to the dark areas of pattern to be reproduced. On the other hand, the illuminated portions of screen 443 corresponding to the light portions of an image to be reproduced block the passage of dark toner particles to varying degrees resulting in the light areas on print receiving medium 449 corresponding to the light areas of an image to be reproduced. The fringing fields established within the apertures of screen 443 in fact vary in strength and polarity from blocking to enhancing and over a continuous range in between to permit continuous tone positive reproduction with continuous gray scale. Thus, the system achieves direct positive electrostatic printing. Other system arrangements and multi-layered apertured screen configurations for direct positive printing are set forth in U.S. patent application Ser. No. 197,877 entitled *Method and Apparatus for Forming a Positive Electrostatic Image*, assigned to the assignee of the present case.

The various electrostatic screen modulators for electrostatic printing herein described are applicable not only for controlling the flow of charged toner particles or droplets or other printing material, but also for controlling the flow of charged particles generally. For example, the modulators can be utilized for controlling flows of ions as set forth in U.S. patent application Ser. No. 709,578, filed Mar. 1, 1968 and entitled *Aperture-Controlled Electrostatic Printing System And Method Employing Ion Projection.*

An electrostatic printing system incorporating an electrostatic screen modulator of the type illustrated in FIGS. 21 through 24 but in the form of an endless web or belt is described in Ser. No. 709,578 referred to above.

In order to produce color prints from the color-encoded black and white transparency, an electrostatic color printer of the type, for example, set forth in U.S. patent application Ser. No. 800,236, filed Feb. 18, 1969, entitled Method And Apparatus For Apertured Controlled Electrostatic Image Color Reproduction or Constitution, or in U.S. Pat. No. 3,532,422 is used modified in accordance with the present invention to separately extract the primary color image components from the color-encoded black and white transparency. A feature and advantage of the color printer of the present invention is that positive color prints are obtained whether the color transparencies from the electrostatic camera are positive or negative.

In FIG. 18, an automatic electrostatic color printer is shown for producing color prints from the black and white transparency in which color information is encoded in the form of gratings of fine lines developed from the electrostatic camera as heretofore described. The printer uses a non-slidable hinged modulated aperture printing screen for perfect registration of the primary color image components extracted from the color encoded black and white transparency. The transparency 507 is interposed in an optical projector of the type described with reference to FIG. 14, positioned in a light-tight housing 503. Thus, the transparency is positioned between collimating lens 501 which collimates coherent light originating from coherent light source 505 on the one side, and the focusing lens 509 and binary mask 502 on the other side. A total of at least three binary masks 502, 504 and 506 are provided pivotally mounted for positioning along the optical axis of the optical train in the image plane of the diffraction pattern focused by lens 509. The three masks 502, 504 and 506 are, for example, opaque masks having apertures or cutouts of the type illustrated in FIGS. 18A, 18B and 18C. These masks separate the light containing the different primary color information and are used to recover the color image components encoded in the transparency by the spatial color-encoding filter illustrated in FIG. 7. Thus, when the spatial filter of the type illustrated in FIG. 7 is utilized in forming the black and white transparency in the electrostatic camera, then binary mask components 502, 504 and 506 are utilized for recovering the primary color information components encoded in the black and white transparency in the form of sets of fine lines corresponding to the gratings of the spatial filter. Alternatively, a single mask 518 can be used as illustrated in FIG. 18D, which is rotated to selected angular positions by engaging gear 520 rotated by knob 522.

A first one of the binary masks, for example mask 502, corresponding to a first primary color image component to be recovered, is interposed in the light path of coherent light originating from source 505 and culminated by lens 501. The coherent light passing through transparency 507 is diffracted in accordance with the grating components recorded in the transparency and focused by lens 509 to provide the focused image of the diffraction spectrum on mask 502. Mask 502 passes diffraction spot patterns produced by fine grating lines of the black and white transparency originally produced by blue light passing through the yellow grating component 7C of spatial filter 7 in the electrostatic camera. This blue color image information is recovered by passing the diffraction spots through the apertures of mask 502 appropriate positioned to recover the first primary color image component. The first image component (containing blue image information) is thereafter focused by lens 510 onto the multilayered apertured screen 511 of the type heretofore described. Thus, the lens has a photoconductive insulating layer facing the lens 510 and a conductive backing layer. The screen is hinged at 515 and is shown in both its horizontal and vertically downward positions, the latter position being used for charging and establishing the double layer charge electrostatic latent image across the face of the screen.

Initially screen 511 is in the vertical or downward position and vacuum cleaner 531 traverses its surface to clean up toner particles. The line corona source 519 is thereafter caused to traverse the screen 511 to initially establish the uniform double layer charge across the photoconductive insulating layer of the screen. The corona source 519 is powered by voltage $E_e$ and rides up and down the rods 523 as shown more clearly in FIG. 19. After charging, the screen is then exposed to the light image component containing the blue color information so that a double layer charge electrostatic latent image is established on the screen. The screen 511 is then pivoted to the horizontal or upper position to form a component in the printing station and the appropriate toner supply, such as, for example, toner supply 533, is activated to supply yellow color toner. The toner supplies are carried by a pair of racks or rails 535 and each toner supply can comprise an elongated trow for passing close to but underneath the screen 511. A propulsion field is established between the toner source and the conductive backing plate 539 in order to direct a stream of charged toner particles through screen 511 and onto the paper or print receiving medium 537. Thus, the propulsion field switch 541 is placed on the upper terminal to apply the propulsion field $E_{py}$ which is adjustable by the potentiometer illustrated. Similarly, contact arm 543 is placed in its upper position to apply an adjustable potential $E_{sy}$ to the conductive layer of the screen. The electrostatic latent image component previously established on the screen modulates the resulting flow of yellow toner particles so that they come to rest on the paper 537 in accordance with the negative of the image component to be reproduced in the first step. The previously mentioned potentials $E_{py}$ and $E_{sy}$ are adjustable to control the overall degree of toning.

This process is then repeated for each of the other color image components using masks 504 and 506, respectively, using toner sources 551 and 553 for supplying magenta (minus green) and cyan (minus red) colored toner, respectively. In addition, a black image component can also be supplied using a different mask and black toner source 555.

The rails are sufficiently long to permit removing the toner sources beyond the screen region after they have been used. Following complete printing, the respective toner sources are returned to the positions shown in FIG. 18 for repeated operations and the color toning of a particular image can be selected and controlled by using, for example, repeat operations for certain of the colors.

The housing 503 includes access doors 560 and 561 for supplying toner and locating the transparency 507 and for manually adjusting the masks if desired, although the operation can be performed automatically.

Automated electrophotographic color printing systems incorporating the principles of the invention described with reference to FIG. 18 can also be provided. Such a system, for example, would be one of the type described with reference to FIG. 35 of U.S. patent application Ser. No. 800,236 referred to above modified in accordance with the present invention. Thus, the imaging optics of that system would be substituted with the optical train described herein with reference to FIG. 18 for extracting, separately, the primary color image information components.

A feature and advantage of the electrophotographic color printing method of the present invention in each of the apparatus embodiments is that the screen is illuminated with white light for each of the image components without being subject to the attenuation of passing through a color filter. Each of the masks sequentially placed in the optical train of light illuminating the color transparency passes only selected ones of the diffraction image spots containing desired primary color image component information. This information is selectively passed by the open apertures of the mask in the form of white light which is imaged onto the screen producing an electrostatic latent image having modulations or variations corresponding to the image component of one of the primary colors.

In FIG. 20, another electrophotographic color printer is shown for producing color prints from the color-encoded black and white transparency. This printer is of the type described in U.S. Pat. No. 3,532,422 modified in accordance with the present invention. The printer uses a woven screen of conductive wires coated with a photoconductive insulating material and the screen is arranged in the form of an endless belt to permit automatic or semi-automatic color reproduction. The endless screen belt 331 is driven around rollers 375 by a sprocket belt 335 which is, in turn, driven by a sprocket gear 333 and motor 332. The sprocket drive arrangement permits accurate registration of the image components during printing as hereinafter described.

The color-encoded black and white transparency 349 of the type heretofore described is interposed in an optical projector of the type described with reference to FIGS. 14 and 18. The printer is enclosed in light-tight housing 341 with access for a placement of the transparency being available through hinged cover 343. Thus, the transparency is similarly positioned between collimating lens 345 which collimates coherent light originating from the coherent light source 347 on the one side and the focusing lens 337 and binary mask 325 on the other side. A total of at least three binary masks or a single binary mask 325, of the type shown in FIG. 18D, rotatable to three angular positions is used. The mask 325 is rotated by drive gear 326 pivotally mounted around axis 328 for appropriate angular positioning along the optical access of the optical train in the image plane of the diffraction pattern focused by lens 337. Knob 329 permits rotation of the mask. Alternately, three binary masks of the type illustrated in FIGS. 18A, 18B, and 18C can be used. The mask 325 is used to separate the light components of the diffraction pattern containing the different primary color information and is used to recover the color image components encoded by the spatial filter of the type illustrated, for example, in FIG. 7 as heretofore described. The light components of the diffraction pattern passed by the binary mask are focused by lens 351 onto the screen 331 providing an image component containing the color information of one of the primary colors.

The screen belt 331 supported by the four drums 375 is driven intermittently by the motor and sprocket drive belt 335. The print-receiving medium, such as paper or other similar material 361 to be printed, is supported by a holder 363 and is inserted in the light-tight housing 341 by a hinged cover 365.

In operation, the transparency 349 is positioned and a first position for binary mask 325 is selected by knob 329 and the motor is stopped for exposure of the screen belt 331. The screen belt is previously uniformly charged by means of the line corona source 397 connected to potential source 398. Exposure of the screen selectively dissipates the charge through the photoconductive layer to ground connection 309 establishing a latent electrostatic image corresponding to the first light component carrying the color information for one of the primary colors. The belt is actuated and the electrostatic latent image is advanced to the toning station 395 consisting of three toner bins 391, 392 and 393, each containing toner of a different one of the three subtractive primary colors. When the electrostatic latent image on the screen is in position, the appropriate roller brush 394 is rotated to agitate and deliver the powder or other toner marking particles. The toner of appropriate subtractive primary color is actually dusted through the belt apertures resting on the screen in the pattern of the color image component.

Another intermittent operation of the screen belt brings the dusted electrostatic latent image into position at the printing station where the paper 361 or other print receiving medium is positioned by holder 363. Accurate positioning of the belt during intermittent operation is accomplished, for example, by means of microswitches 201 and 207 actuated by lever 203 carried by the belt 331. At the printing station the dusted image component is projected across the air gap between the screen and print receiving medium to provide non-contact transfer printing by means of an overall applied electrostatic field applied between the conductive layer of the screen and the backing plate support for the paper or other print receiving medium.

The printing steps are repeated through each of the primary image components using in the subsequent steps cyan and magenta colored toner. A fourth trimming step for a black image component can also be provided using black colored toner. Each component is accurately registered and superimposed on the print receiving medium and fixed by heaters 209 and 211. Further details of the electrostatic color printing process and apparatus are fully set forth in U.S. Pat. No. 3,532,422.

I claim:

1. A method comprising:

focusing light from a multicolor object field to be photographed through a color-encoding spatial filter and transparent conductive layer onto a single adjacent photoconductive insulating layer, forming a color-encoded image corresponding to the multicolor object field thereon, said spatial filter comprised of a plurality of at least three gratings, each grating including spaced lines of the same color, three of the gratings being of different primary subtractive colors thereby encoding the object color information in the formed image in the form of a plurality of sets of fine lines corresponding to the respective gratings of the spatial filter;

positioning a single film of transparent dielectric material adjacent the surface of the photoconductive layer opposite the transparent conductive layer;

pressure biasing the film against the photoconductive surface by means of a conductive pressure plate;

applying a voltage pulse between the transparent conductive layer and the conductive pressure plate during the aforesaid step of focusing light from the multicolor object field onto the photoconductive layer thereby forming a color-encoded electrostatic latent image corresponding to the multicolor object field on the film;

developing said electrostatic latent image to form a black and white transparency having the object multicolor information encoded therein in the form of a plurality of sets of fine lines;

illuminating said transparency with coherent light;

focusing the light passing through said transparency onto a mask positioned in the Fourier transform plane of the light passing through the transparency, said mask having at least one aperture disposed in the position of the diffraction pattern formed by a first one of the sets of fine lines encoded in the image transparency, corresponding to a first one of the gratings of the color-encoding spatial filter;

imaging the light passing through said mask at an electrostatic printing station to provide a first image component;

developing said first image component on a print receiving medium with marking particles of a first color;

changing said mask to provide at least one aperture at a second position being the diffraction pattern formed by a second one of the sets of fine lines encoded in the image transparency corresponding to a second one of the gratings of the color-encoding spatial filter;

imaging the light passing through said mask at said electrostatic printing station to provide a second image component;

developing said second image component on said print receiving medium over the first image component with marking particles of a second color;

changing said mask to provide at least one aperture at a third position being the diffraction pattern formed by a third one of the sets of fine lines encoded in the image transparency corresponding to a third one of the gratings of the color-encoding spatial filter;

imaging the light passing through said mask at said electrostatic printing station to provide a third image component;

and developing said third image component on said print receiving medium over the first and second image components with marking particles of a third color;

wherein the steps of imaging at an electrostatic printing station comprise imaging the light passing through said mask onto a multi-layered apertured screen comprising at least a photoconductive insulating layer and a conductive layer, said apertured screen positioned at a printing station having a source of charged particles disposed on one side thereof and a print-receiving medium and back electrode disposed on the other side thereof, forming an electrostatic latent image of the image component across said screen, the electrostatic latent image comprised of fringing fields in the apertures of the apertured screen, and directing a flow of charged particles through said screen thereby to modulate the flow in accordance with the electrostatic latent image component pattern.

2. The method of claim 1 wherein said charged particles comprise ions.

3. Method of claim 1 wherein said charged particles comprise toner marking particles of appropriate color.

4. The method of claim 1 wherein the fringing fields are established by means of two oppositely polarized layers of electrical charge one of which is located on one side of said photoconductive layer and the other of which is located on the opposite side of said photoconductive layer.

5. The method of claim 1 wherein the fringing fields are established by means of voltage drops of selected magnitude and orientation between opposed surfaces of the photoconductive layer.

6. The method of claim 1 wherein the film includes the combination of the transparent dielectric layer and the transparent conductive layer arranged with the transparent conductive layer facing the object field.

7. The method of claim 6 wherein said charged particles comprise ions.

8. The method of claim 6 wherein said charged particles comprise toner marking particles of appropriate color.

9. The method of claim 6 wherein the fringing fields are established by means of two oppositely polarized layers of electrical charge, one of which is located on one side of said photoconductive layer and the other of which is located on the opposite side of said photoconductive layer.

10. The method of claim 6 wherein the fringing fields are established by means of voltage drops of selected magnitude and orientation between opposed surfaces of the photoconductive layer.

* * * * *